US005357867A

United States Patent [19]

Theurer et al.

[11] Patent Number: 5,357,867

[45] Date of Patent: Oct. 25, 1994

[54] MACHINE FOR RENEWING OR LAYING A RAILWAY TRACK

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 89,779

[22] Filed: Jul. 9, 1993

[30] Foreign Application Priority Data

Apr. 20, 1993 [DE] Fed. Rep. of Germany ... 9305927[U]

[51] Int. Cl.[5] ..... E01B 29/00

[52] U.S. Cl. ..... 104/2; 104/7.1

[58] Field of Search ..... 104/2, 7.1, 7.2, 7.3, 104/12

[56] References Cited

U.S. PATENT DOCUMENTS

| | | | |
|---|---|---|---|
| 3,691,957 | 9/1972 | Plasser et al. | 104/9 |
| 4,046,077 | 9/1977 | Theurer et al. | 104/2 |
| 4,094,249 | 6/1978 | Theurer et al. | 104/2 |
| 4,108,076 | 8/1978 | Knape | 104/2 |
| 4,178,995 | 12/1979 | Theurer et al. | 104/2 |
| 4,184,431 | 1/1980 | Goel | 104/2 |
| 4,207,820 | 6/1980 | Cicin-Sain | 104/2 |
| 4,236,452 | 12/1980 | Theurer et al. | 104/2 |
| 4,253,398 | 3/1981 | Theurer et al. | 104/7.1 |
| 4,428,296 | 1/1984 | Scheuchzer et al. | 104/2 |
| 4,479,439 | 10/1984 | Theurer et al. | 104/2 |
| 4,979,247 | 12/1990 | Buhler | 104/7.1 |
| 5,092,247 | 3/1992 | Aubermann | 104/2 |
| 5,222,435 | 6/1993 | Theurer et al. | 104/2 |

FOREIGN PATENT DOCUMENTS

| | | | |
|---|---|---|---|
| 0388573 | 9/1990 | European Pat. Off. | 104/7.1 |
| 2036141 | 6/1980 | United Kingdom | 104/2 |
| 2067630 | 7/1981 | United Kingdom | 104/2 |

*Primary Examiner*—Mark T. Le
*Attorney, Agent, or Firm*—Collard & Roe

[57] ABSTRACT

A machine for renewing and laying a railway track comprises an elongated machine frame and undercarriages supporting the machine frame at the ends thereof. The undercarriages include at one of the machine ends an undercarriage which is vertically adjustable relative to the machine frame and detachable therefrom, the vertically adjustable undercarriage not being track-bound, and a track-bound undercarriage which is arranged adjacent the vertically adjustable undercarriage and is detachable from the machine frame. A first coupling detachably mounts the vertically adjustable undercarriage on the machine frame and a second coupling is provided at the track-bound undercarriage for mounting the vertically adjustable undercarriage on the machine frame. The machine also comprises a device for receiving old ties mounted on the machine frame, a device for laying new ties mounted on the machine frame, a vertically adjustable device for planing the ballast bed mounted on the machine frame between said devices, and guides mounted on the machine frame for guiding old and new rails.

10 Claims, 2 Drawing Sheets

MACHINE FOR RENEWING OR LAYING A RAILWAY TRACK

BACKGROUND OF THE INVENTION

1. Field of the Invention

The present invention relates a machine for renewing and laying a railway track including two rails and ties supported on a ballast bed, which comprises an elongated machine frame having two opposite ends and undercarriages supporting the machine frame at the ends thereof, the undercarriages including at one of the machine ends an undercarriage which is vertically adjustable relative to the machine frame, the vertically adjustable undercarriage not being track-bound, and a track-bound undercarriage which is arranged adjacent the vertically adjustable undercarriage. The machine also comprises a device for receiving old ties mounted on the machine frame, a device for laying new ties mounted on the machine frame, a vertically adjustable device for planing the ballast bed mounted on the machine frame between said devices, and means mounted on the machine frame for guiding old and new rails.

2. Description of the Prior Art

U.S. Pat. No. 4,184,431 discloses a machine of this type, which may be used for laying a new track or for renewing an old track. The machine comprises a bridge-like, elongated machine frame supported by undercarriages at the opposite ends thereof and tie transport cars are coupled to its rear end, relative to the operating direction, which is the same for renewing or laying track. A tracked vehicle is vertically adjustably mounted on the machine frame immediately behind the front bogie and is steerable when lowered onto the ballast bed. The operating devices for receiving and laying the ties are mounted behind the tracked vehicle on a carrier frame which may be vertically adjusted, the device for receiving the old ties and the ballast bed planing device being additionally vertically adjustable relative to the carrier frame.

In a track renewal operation, the machine runs with its front bogie on the old track, while the tracked vehicle is retracted, while the rear bogie runs on the newly laid track. The exchange of the old ties and rails for the new ties and rails, as well as the planing of the ballast bed, is effectuated between the front and rear bogies while the machine advances continuously, and a gantry is provided to deliver the new ties and remove the old ties. When laying a new track on a prepared ballast bed, the tracked vehicle is lowered, causing the front end of the machine frame and the front bogie to be raised so that the front machine end rolls along the ballast bed as it is supported on the tracked vehicle. The rear bogie runs on the track newly laid by the operating devices on the machine frame while the device for receiving the old ties and the ballast bed planing device are raised into their inoperative positions. Because the rails must be spread to the desired track gage within the relatively short distance between the device for laying the new ties and the rear bogie, they are subjected to considerable bending stresses, which may exceed permissible limits.

Another machine for renewing track and laying new track has been disclosed in U.S. Pat. No. 4,207,820. It comprises a two-part machine frame whose parts are linked together. One machine frame part is supported by two track-bound bogies while the other machine frame part is a trailer linked at one end to the one machine frame part while its other end is supported by a bogie. An operator's cab is mounted on the trailer part. A carrier frame for tie receiving and laying devices as well as a ballast bed planing device is linked to both machine frame parts below the joint linking the two parts together. In a track renewal operation, the machine advances in an operating direction in which the operator's cab is at the rear and the trailer bogie runs on the newly laid track while the front bogie of the one machine frame parts runs on the old track. The other bogie of the one machine frame part adjacent the joint linking the machine frame parts together does not engage the old track but the one machine frame part is supported at this point by an auxiliary bogie engaging the new rails which lie on the track shoulders adjacent the old rails. When a new track is to be laid, the machine is operated in the opposite direction, i.e. the operator's cab is in front and the front end of the trailer is supported by an auxiliary bogie on newly laid rails. A device behind the auxiliary bogie lays the new ties while the other operating devices remain inoperative and the rear bogies run on the newly laid track.

U.S. Pat. No. 5,092,247 discloses a process for converting a track renewal train into a machine for laying a new track. For this purpose, a track-bound undercarriage, which runs at the rear of the machine on the newly laid track during a track renewal operation, is carried on a self-propelled tracked vehicle which runs on the ballast bed when a new track is laid as the machine operates in the opposite direction. When the machine is converted from one to the other use, the various operating devices for exchanging the ties and rails are partly put out of operation and partly adapted for laying the new track in the opposite direction.

U.S. Pat. No. 3,691,957 discloses a mobile apparatus for laying and removing track ties along a right of way. This apparatus comprises a machine frame one of whose ends is supported on a track by a track-bound undercarriage while a track-bound undercarriage or a vertically adjustable tracked vehicle selectively support the other machine frame end either on the track or on the ballast bed when the track is raised to enable a tie exchange mechanism on the machine frame to remove the old ties and lay the new ties.

U.S. Pat. No. 4,236,452 discloses a track renewal train which includes a semi-trailer work car which carries track renewal equipment and has two selectively usable undercarriages for supporting the rear end of the work car. One of the undercarriages is a tracked vehicle for supporting the work car on the ballast bed portion where the track renewal is effected and the other undercarriage is a vertically adjustable track-bound bogie.

SUMMARY OF THE INVENTION

It is the primary object of this invention to provide a machine of the first-described type which may be readily used either for laying new track or for renewing an existing track, with a minimum of retrofitting work and an advantageous use of the tracked vehicle in either operation.

In a machine of this type, the above and other objects are accomplished according to the invention with undercarriages including at one of the machine frame ends an undercarriage which is vertically adjustable relative to the machine frame and detachable therefrom, the vertically adjustable undercarriage not being track-bound, and a track-bound undercarriage which is arranged adjacent the vertically adjustable undercarriage and is detachable from the machine frame. A first coupling detachably mounts the vertically adjustable undercarriage on the machine frame and a second coupling at the track-bound undercarriage mounts the vertically adjustable undercarriage on the machine frame.

Such a machine, in which the vertically adjustable tracked undercarriage can be used in a track renewal operation as well as in laying a new track, can be readily and rapidly adapted for either use. The adaptation requires only the detachment of the track-bound undercarriage at the one machine frame end and the detachment of the tracked undercarriage from the first coupling and its attachment to the second coupling. In both operations, the long distance over which the rails are bent during the rail exchange and the device for laying the new ties may be advantageously maintained.

Preferably, the device for laying new ties is arranged between the detachable undercarriages at the one machine end. This advantageously makes it possible to lay the new ties immediately behind the tracked undercarriage in both operating directions of the machine, whether it is used for track renewal in one operating direction or for laying new track in the opposite operating direction. This assures that the flexing curve of the rails to be laid is not too sharp—particularly when laying new track—, even if the machine frame is not very long, since a maximum distance is available under the machine frame for guiding the new rails to the desired track gage.

If the vertically adjustable undercarriage is a steerable tracked vehicle comprising two endless tracks spaced from each other in a direction extending transversely to the elongated machine frame, the machine may be optimally steered during operation while the tracked vehicle rolls on any ballast surface securely and without problems.

Desirably, the two endless tracks are spaced a distance of about 900 mm from each other, and are drivable by a reversible drive in opposite directions. In this way, the tracks will compact the ballast before the new ties are laid at the points where the rails are supported on the ballast.

According to a preferred embodiment, the tracked vehicle comprises a support centered between the two endless tracks and a centering pivot on the support for supporting the machine frame, and the second coupling for mounting the vertically adjustable undercarriage on the machine frame is an intermediate bearing having a lower end defining an opening for receiving the centering pivot and an upper end connectable to the machine frame. This provides a simple and sturdy structure enabling the tracked vehicle rapidly and with a minimum of work to be detached from the first coupling and attached to the second coupling. If braces connect the tracked vehicle to the machine frame at points spaced from the intermediate bearing in the direction of the machine frame elongation, the braces extending obliquely to a plane defined by the track and being linked to the support, the stability of the support of the tracked vehicle in the direction of elongation of the machine frame will be considerably enhanced.

According to other preferred embodiments which further simplify and optimize the retrofitting work in which the tracked vehicle is moved from the first to the second coupling, the vertically adjustable undercarriage comprises a drive and a hydraulic conduit means for supplying power to the drive, and hydraulic connections are provided at the second coupling for coupling the hydraulic conduit means thereto. Furthermore, a vertically adjustable auxiliary undercarriage is mounted on the machine frame adjacent the vertically adjustable undercarriage, and a drive is provided for vertically adjusting the auxiliary undercarriage.

The efficiency of the machine in track renewal operations is enhanced if it comprises a vertically adjustable ballast bed excavating device mounted on the machine frame between said devices for receiving the old ties and laying the new ties, the excavating device comprising a ballast discharge conveyor extending transversely to the direction of elongation of the machine frame, and the ballast bed planing device being arranged between the excavating device and the device for laying the new ties.

BRIEF DESCRIPTION OF THE DRAWING

The above and other objects, features and advantages of the present invention will become more apparent from the following detailed description of a now preferred embodiment thereof, taken in conjunction with the accompanying, partly schematic drawing wherein.

DETAILED DESCRIPTION OF THE PREFERRED EMBODIMENT

Figure 1:
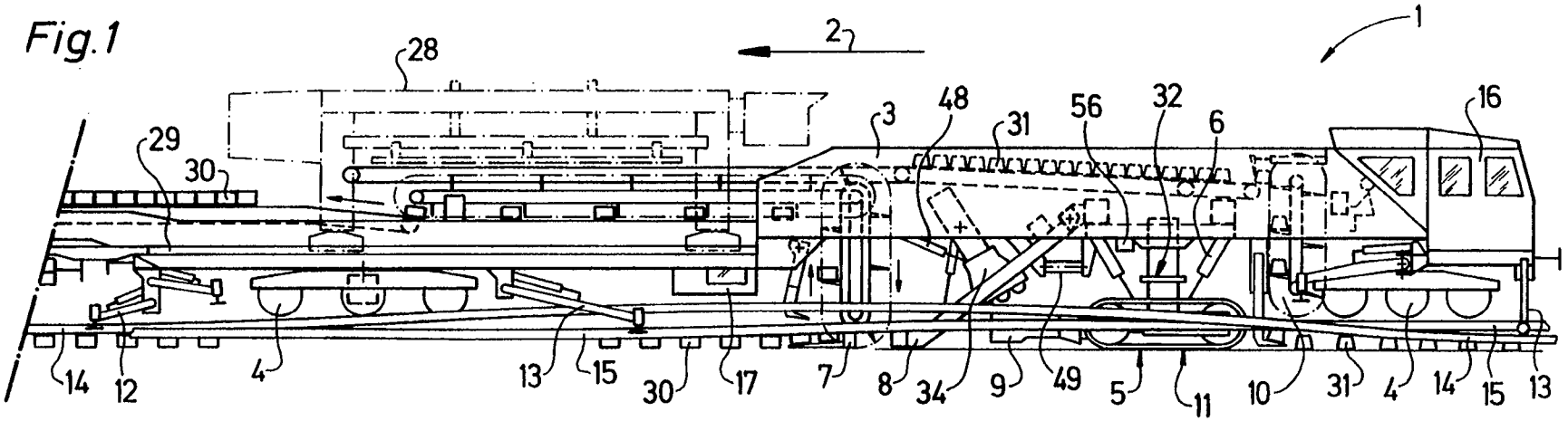
FIG. 1 is a side elevational view of a machine operated in its track renewal mode according to this invention.

Referring now to the drawing and first to FIG. 1, there is shown machine 1 for either renewing and or laying a railway track including two rails and ties supported on a ballast bed. When used for track renewal, as shown in FIG. 1, the machine advances in an operating direction indicated by arrow 2. Machine 1 comprises elongated machine frame 3 having two opposite ends and undercarriages 4, 5 support the machine frame at the ends thereof. The undercarriages include at one of the machine frame ends undercarriage 5 which is vertically adjustable by drives 6 relative to machine frame 3 and is detachable therefrom, the vertically adjustable undercarriage not being track-bound, and track-bound undercarriage 4 which is arranged adjacent vertically adjustable undercarriage 5 and is also detachable from the machine frame. Another track-bound undercarriage 4 supports machine frame 3 at the opposite end thereof.

According to the invention, a first coupling 32 is provided for detachably mounting vertically adjustable undercarriage 5 on machine frame 3, and a second coupling 33 (see FIG. 3) at track-bound undercarriage 4 is provided under driver's cab 16 for mounting the vertically adjustable undercarriage on the machine frame when the machine 1 is used to lay a new track.

Furthermore, device 7 for receiving old ties 30 and device 10 for laying new ties 31 are mounted on machine frame 3, and vertically adjustable device 9 for planing the ballast bed is mounted on the machine frame between tie receiving and laying devices 7 and 10. Device 10 for laying new ties is arranged between detachable undercarriages 4 and 5 at the one machine end.

Vertically adjustable ballast bed excavating device 8 is mounted on machine frame 3 between devices 7 and 10 for receiving old ties 30 and laying new ties 31. Excavating device 8 comprises ballast discharge conveyor 49 extending transversely to the direction of elongation of machine frame 3, and ballast bed planing device 9 is arranged between excavating device 8 and device 10 for laying new ties 31. Means 12, 13 are mounted on machine frame 3 for guiding old rails 14 and new rails 15 along each side of the machine frame. Driver's cab 16 is mounted at the one machine frame end and operator's cab 17 is mounted centrally on the machine frame within view of device 7 for receiving old ties 30.

Figure 2:
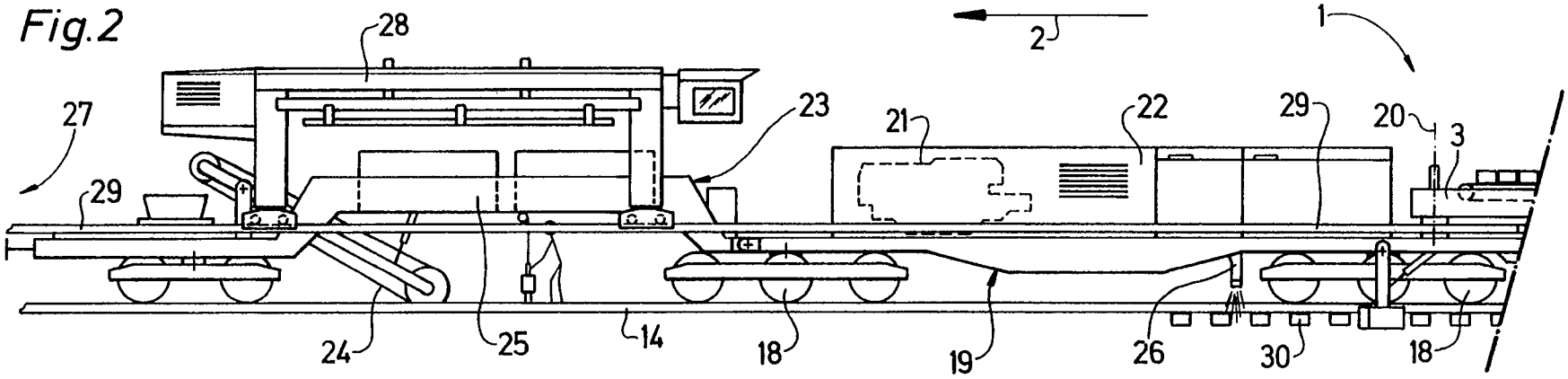
FIG. 2 is a like view showing work cars coupled to the machine to provide a track renewal train.

FIG. 2 illustrates drive car 19 whose opposite ends are supported by undercarriages 18, 18 running on old rails 14 fastened to old ties 30. The end of machine frame 3 opposite to the one end carrying driver's cab 16 is vertically adjustably and pivotally supported on vertical axis 20 mounted on one end of drive car 19. Another work car 23 is coupled to the opposite car end like a trailer. A central power source 21 and a hydraulic fluid source 22 are mounted on drive car 19 to supply all the operating drives of machine 1 with power. The other work car 23 trailing drive car 19 is equipped with a collector device 24 for picking up ferrous rail fastening elements after they have been detached and water tanks 25 connected to jets 26 on drive car 19 to supply water to the jets for spraying onto the track. A suitable number of tie transport cars 27 (not shown) are coupled to trailing car 23 and gantry crane 28 runs back and forth along continuous track 29 extending from transport cars 27 to machine frame 3 to remove layers of old ties 30 from the operating site and to deliver layers of new ties 31 thereto.

Figure 3:
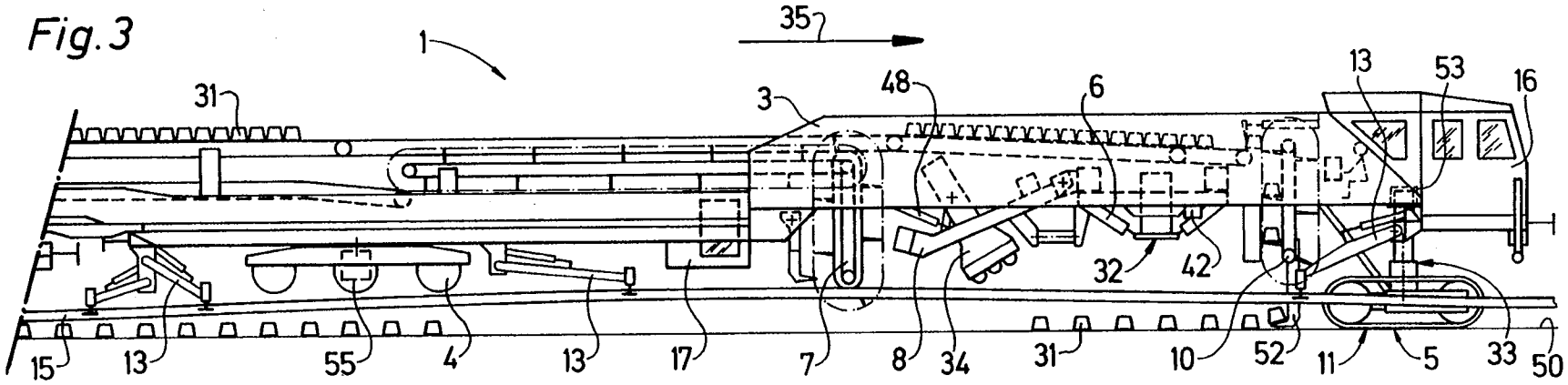
FIG. 3 is a like view showing the machine of FIG. 1 retrofitted for laying a new track.

As shown in FIG. 3, when machine 1 is to be used for laying a new track, track-bound undercarriage 4 at the one end of machine frame 3 is detached and undercarriage 5 is detached from first coupling 32 and attached to second coupling 33. During this exchange of the undercarriages, vertically adjustable auxiliary undercarriage 34, which is mounted on the machine frame adjacent vertically adjustable undercarriage 5, is lowered by drive 48 which links the auxiliary undercarriage to machine frame 3. In this way, the one end of machine frame 3 is temporarily supported by the auxiliary undercarriage while undercarriages 4 and 5 are exchanged. During the laying of a new track, machine 1 operates in the opposite direction indicated by arrow 35.

Figure 5:
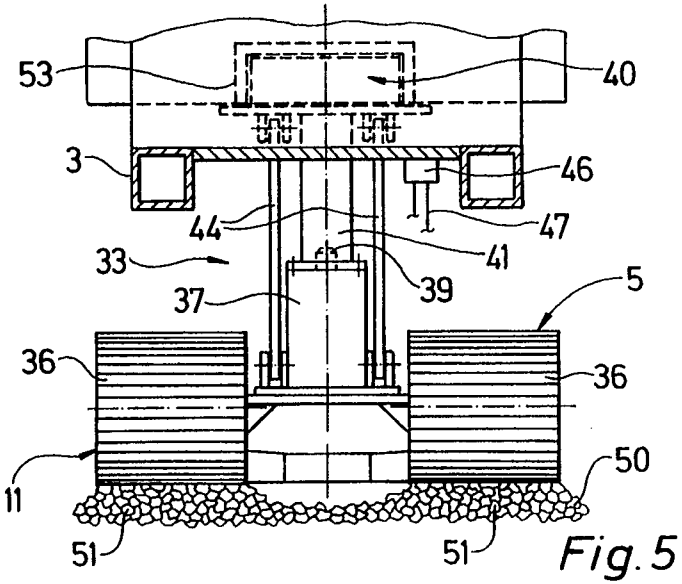
FIG. 5 is an end view of the tracked vehicle, seen in the direction of arrow V in FIG. 4.
Figure 4:
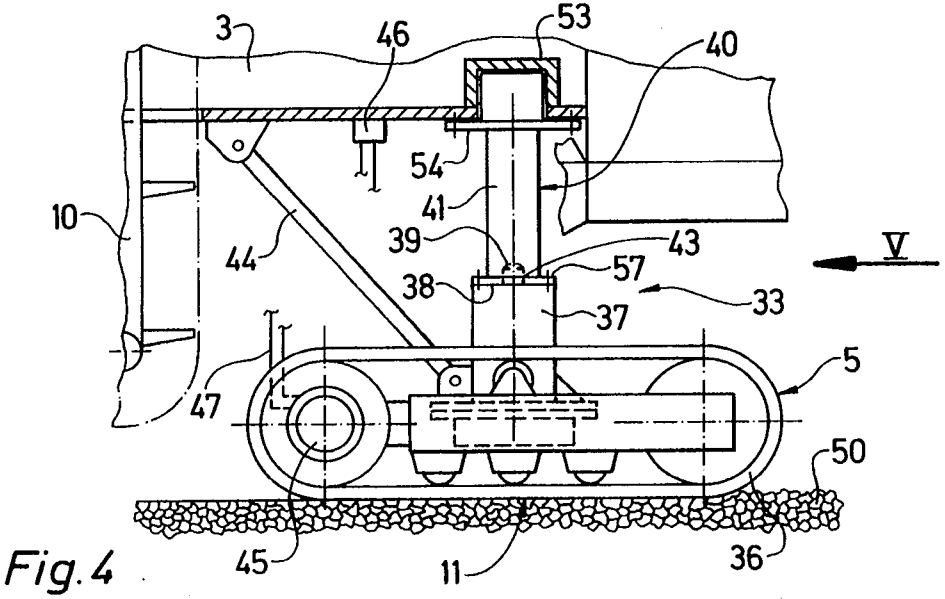
FIG. 4 is an enlarged, fragmentary side view of the tracked vehicle in the FIG. 3 position.

As shown in FIGS. 4 and 5, vertically adjustable undercarriage 5 preferably is a steerable tracked vehicle 11 comprising two endless tracks 36 spaced from each other in a direction extending transversely to elongated machine frame 3. The two endless tracks extend parallel to each other and are advantageously spaced a distance of about 900 mm from each other, and are driven by reversible drive 45 operable for moving the tracks in opposite directions.

The tracked vehicle comprises a support 37 centered between the two endless tracks 36, 36 and a centering pivot 39 on the support for supporting machine frame 3. Second coupling 33 for mounting vertically adjustable undercarriage 5 on machine frame 3 is an intermediate bearing 40 having a lower end defining opening 43 for receiving centering pivot 39 and an upper end connectable to the machine frame. Support 37 has a horizontal upper plate 38 and centering pivot 39 is mounted in the center of plate 38. Intermediate bearing 40 is a column 41 whose upper end extends into bushing 53 in machine frame 3 and is detachably connected to the machine frame by flange 54. A further detachable flange connection 57 connects column 41 to support 37.

As shown in FIG. 4, the support of tracked vehicle 11 on machine frame 3 in the direction of elongation of the machine frame is enhanced by two braces 44 connecting support 37 of the tracked vehicle to machine frame 3 at points spaced from intermediate bearing 40 in the direction of the machine frame elongation, the braces extending obliquely to a plane defined by the track and being linked to the machine frame and the support. Braces 44 extend at an angle of about 45°.

Hydraulic conduit means 47 on vertically adjustable undercarriage 5 supply hydraulic fluid to drive 45 to power the drive, and hydraulic connections 46 at first and second couplings 32, 33 enable hydraulic conduit means 47 to be coupled thereto.

In operation, machine 1 is supported on front and rear track-bound undercarriages 4, 4 when it is driven to an operating site on existing track. When the machine arrives at the operating site, undercarriage 4 at the end of machine frame 3 opposite to driver's cab 16 is raised off the track along axis 20 while this machine frame end remains supported on drive car 19. In this way, the operating space below machine frame 3 is extended.

When the machine is used for track renewal (FIG. 1), drive 6 is actuated to lower tracked vehicle 11 into engagement with the ballast bed to support the one end of machine frame 3 thereon and to cause this one machine frame end with track-bound undercarriage 4 to be raised into an inoperative position. As machine 1 continuously advances in the operating direction indicated by arrow 2, with its front end supported on drive car 19 and its rear end supported on tracked vehicle 11, the rail fastening elements are loosened and collected by device 24. In difficult track conditions, excess dust may be eliminated by operating water jets 26. After removal of the rail fastening elements, old rails 14 are raised and spread apart by rail guide devices 12, whereupon old ties 30 are removed by device 7 which receives the old ties. The old ties are then forwardly conveyed by gantry crane 28 to transport cars 27. The ballast bed is then planed by ballast excavating device 8 and succeeding ballast bed planing device 9 which imparts a desired surface configuration to the ballast bed. Excess ballast excavated by device 8 is conveyed to the shoulder by transversely extending discharge conveyor 49 and the planed ballast is compacted by succeeding endless tracks 36 of tracked vehicle 11 along two bands underlying the new rails to be laid. Immediately behind the tracked vehicle, device 10 lays new ties 31 conveyed thereto by gantry crane 28. Rail guide device 13 is then used to lay new rails 15 at the desired track gage, the long bending distance enabling the new rails to be laid on new ties 31 without internal stress behind machine 1.

The retrofitting of tracked vehicle 11 for use of machine 1 in the laying of a new track (FIG. 3) may most advantageously be done on a branch track adjacent the operating site or at a nearby railroad station. Auxiliary undercarriage 34 is first lowered into engagement with the track while ballast excavating device 8 and ballast bed planing device 9 are raised into their inoperative positions. Subsequently, hydraulic conduit means 47 supplying power to tracked vehicle drive 45 are disconnected from support 37 and hydraulic connection 56 at first coupling 32. Track-bound undercarriage 4 adjacent tracked vehicle 11 is similarly disconnected. Further lowering of auxiliary undercarriage 34 will cause the one machine frame end to be raised to detach undercarriages 4 and 5 from the machine frame after flange connections 54 have been loosened. Drive 55 is then operated to advance the machine in the direction indicated by arrow 2 until support 37 of tracked vehicle 11 is in alignment with bushing 53 at the second coupling. Flanged connection 54 is then tightened to fix intermediate bearing 40 on machine frame 3. Flange connection 57 is then tightened to connect tracked vehicle 11 to the intermediate bearing. The insertion of centering pivot 39 into opening 43 may be facilitated during the coupling operation by a slight vertical adjustment of auxiliary undercarriage 34. After braces 44 have been fixed in position and hydraulic conduit means 47 has been coupled to hydraulic connection 46 at second coupling 33, tracked vehicle 11 is in position for a track laying operation of the machine. The only thing still required is the reversal of the position of the tie-holding fork 52 of tie laying device 10 since the machine operates in the opposite direction from that during a track renewal operation.

After the retrofitting operation has been completed and while auxiliary undercarriage remains lowered and tracked vehicle 11 is retracted, machine 1 is moved from the branch track, whereon detached track-bound undercarriage 4 remains, to the main track along which it is moved to the operating site in the direction indicated by arrow 35. When the operating site is reached and tracked vehicle 11 of machine 1 is located above the prepared trackless ballast bed, auxiliary undercarriage is raised into its inoperative position and tracked vehicle 11 is lowered into engagement with the ballast bed. Ballast excavating and planing devices 8, 9 remain in their raised, inoperative positions. As the machine advances continuously in the direction of arrow 35, new ties 31 are sequentially laid on the ballast bed by device 10 and new rails 15, which have been stored at the operating site, are laid on the new ties by guide devices 13. Undercarriages 18 of drive car 19 run on the newly laid track.

The operations of the ballast excavating and planing devices, as well as the tie and rail exchanging devices for track renewal as well as the laying of new track, are conventional and are shown, for example, in the prior art of record herein. To avoid undue prolixity, they have not been described in detail.

What is claimed is:

1. A machine for renewing and laying a railway track including two rails and ties supported on a ballast bed, which comprises (a) an elongated machine frame having two opposite ends, (b) undercarriages supporting the machine frame at the ends thereof, the undercarriages including at one of the machine frame ends (1) an undercarriage which is vertically adjustable relative to the machine frame and detachable therefrom, the vertically adjustable undercarriage not being track-bound, and (2) a track-bound undercarriage which is arranged adjacent the vertically adjustable undercarriage and is detachable from the machine frame, (c) a first coupling for detachably mounting the vertically adjustable undercarriage on the machine frame, (d) a second coupling at the track-bound undercarriage for mounting the vertically adjustable undercarriage on the machine frame, (e) a device for receiving old ties mounted on the machine frame, (f) a device for laying new ties mounted on the machine frame, (g) a vertically adjustable device for planing the ballast bed mounted on the machine frame between said devices, and (h) means mounted on the machine frame for guiding old and new rails.

2. The machine of claim 1, wherein the device for laying new ties is arranged between the detachable undercarriages at the one machine end.

3. The machine of claim 1, wherein the vertically adjustable undercarriage is a steerable tracked vehicle comprising two endless tracks spaced from each other in a direction extending transversely to the elongated machine frame.

4. The machine of claim 3, wherein the two endless tracks are spaced a distance of about 900 mm from each other, and further comprising a reversible drive for driving the tracks in opposite directions.

5. The machine of claim 3, wherein the tracked vehicle comprises a support centered between the two endless tracks and a centering pivot on the support for supporting the machine frame.

6. The machine of claim 5, wherein the second coupling for mounting the vertically adjustable undercarriage on the machine frame is an intermediate bearing having a lower end defining an opening for receiving the centering pivot and an upper end connectable to the machine frame.

7. The machine of claim 6, further comprising braces connecting the tracked vehicle to the machine frame at points spaced from the intermediate bearing in the direction of the machine frame elongation, the braces extending obliquely to a plane defined by the track and being linked to the support.

8. The machine of claim 1, wherein the vertically adjustable undercarriage comprises a drive and a hydraulic conduit means for supplying power to the drive, and further comprising hydraulic connections at the second coupling for coupling the hydraulic conduit means thereto.

9. The machine of claim 1, further comprising a vertically adjustable auxiliary undercarriage mounted on the machine frame adjacent the vertically adjustable undercarriage, and a drive for vertically adjusting the auxiliary undercarriage.

10. The machine of claim 1, further comprising a vertically adjustable ballast bed excavating device mounted on the machine frame between said devices for receiving the old ties and laying the new ties, the excavating device comprising a ballast discharge conveyor extending transversely to the direction of elongation of the machine frame, and the ballast bed planing device being arranged between the excavating device and the device for laying the new ties.

* * * * *